United States Patent [19]

Rose et al.

[11] 3,978,316

[45] Aug. 31, 1976

[54] ELECTRICAL HEATING UNIT

[75] Inventors: Paul L. Rose, Corning; William P. Whitney, Big Flats; Thomas Williams, Corning, all of N.Y.

[73] Assignee: Corning Glass Works, Corning, N.Y.

[22] Filed: Sept. 19, 1975

[21] Appl. No.: 614,797

[52] U.S. Cl. ..... 219/543; 338/308; 427/125

[51] Int. Cl.[2] ..... H05B 3/16

[58] Field of Search ..... 219/438, 464, 543; 252/514; 338/308, 309; 427/96, 123, 124, 125

[56] References Cited

UNITED STATES PATENTS

| | | | |
|---|---|---|---|
| 3,067,315 | 12/1962 | Hurko | 219/543 |
| 3,496,336 | 2/1970 | Hingorany et al. | 219/464 |
| 3,679,473 | 7/1972 | Blatchford et al. | 427/96 |
| 3,694,627 | 9/1972 | Blatchford et al. | 219/543 |
| 3,805,023 | 4/1974 | Wainer et al. | 219/543 |
| 3,869,596 | 3/1975 | Howie | 219/438 |

*Primary Examiner*—Volodymyr Y. Mayewsky
*Attorney, Agent, or Firm*—Kees van der Sterre; Clinton S. Janes, Jr.; Clarence R. Patty, Jr.

[57] ABSTRACT

An electrical heating unit of the integral element type, comprising an electrical heating element indirectly bonded to a supporting beta quartz-zinc petalite glass-ceramic plate is described. A semicrystalline zinc aluminosilicate coating is provided between the glass-ceramic plate and the heating element, to improve the adherence and stabilize the resistance of the element and to protect the plate from deterioration during and subsequent to the bonding of the integral heating element to the unit.

3 Claims, 1 Drawing Figure

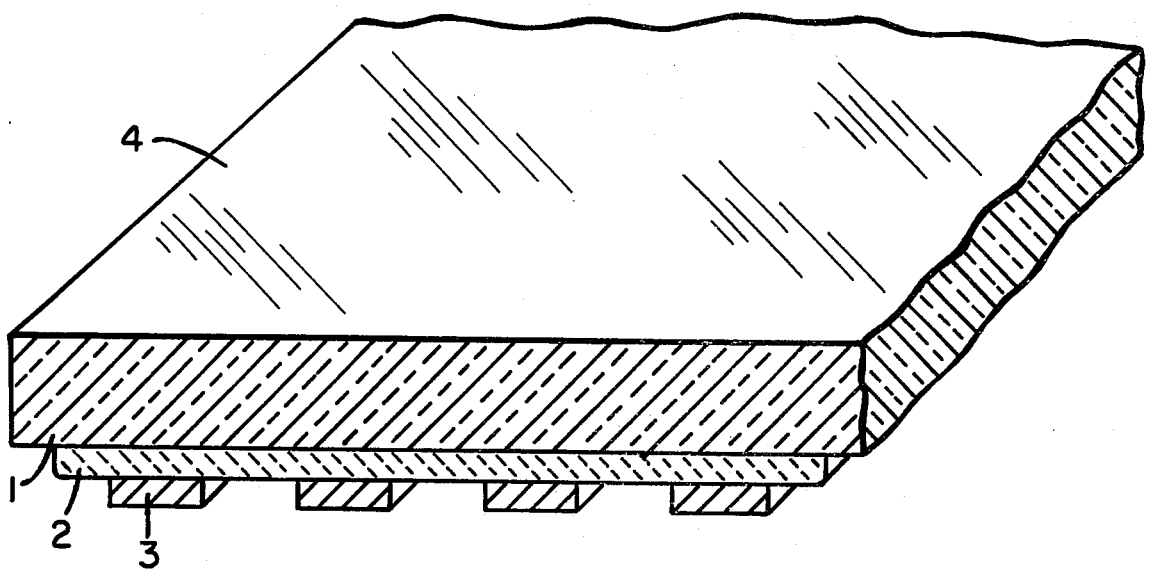
4
1
2
3

ELECTRICAL HEATING UNIT

BACKGROUND OF THE INVENTION

The present invention is in the field of electrical heating and relates to electrical heating units of the so-called integral element type comprising a glass or other ceramic plate or block as the heating surface, which plate or block is heated by an electrical heating element bonded to and supported thereby. Such heating units are particularly useful for electrical cooking ranges, hot plates, and other electrical heating appliances.

U.S. Pat. No. 3,086,101 discloses an electrical heating unit of the discrete element type, comprising a glass plate having an electrical heating element positioned in physical contact with the lower surface of the plate. The unit may optionally include an alumina coating between the heating element and the plate to prevent chemical interaction therebetween during use at elevated temperatures.

U.S. Pat. No. 3,067,315 discloses an electrical heating unit of improved heating characteristics comprising a high silica glass plate having directly bonded thereto a thin noble metal film which acts as the electrical heating element of the unit. However, supporting plates having lower optical transparency and increased impact strength are desired.

Since the discovery of the so-called glass-ceramic family of ceramic materials, such as described in U.S. Pat. No. 2,920,971, electrical heating units comprising glass-ceramic heating plates have been developed. The strength, low porosity, and excellent thermal properties of some of these glass-ceramic materials have provided electric ranges and other electrical heating units of excellent appearance and cleanability. Up to the present time, however, such units have generally been of the discrete electrical element type, such as described in British Pat. No. 1,391,076 and U.S. Pat. No. 3,889,021, wherein the electrical heating element is not directly bonded to but is simply in close proximity to the glass-ceramic plate to be heated. Numerous problems are associated with the development of heating units comprising electric heating elements integrally bonded to the glass-ceramic heating plate.

One of the most important requirements of a glass-ceramic material to be utilized as a burner plate for an electrical heating unit is high strength. Such plates may be subjected to heavy impacts in use, and the cost of replacement of the entire plate upon breakage is prohibitive. Glass-ceramic materials normally exhibit higher modulus of rupture strengths than glasses; hence glass-ceramic electrical heating units of the discrete element type typically exhibit adequate resistance to breakage on impact.

Examples of glass-ceramic materials exhibiting properties rendering them particularly suitable for this use are the beta quartz-zinc petalite glass-ceramic materials described in U.S. Pat. No. 3,681,097 to Beall and Martin. Glass-ceramics of this type are known which exhibit modulus of rupture strengths in excess of about 15,000 psi, average linear coefficients of thermal expansion in the range of about $-5$ to $+20 \times 10^{-7}$/°C. over the range from 0°–800°C., good opacity, and excellent chemical durability. Moreover, these glass-ceramics exhibit high electrical resistivity, even at elevated temperatures, such that additional electrical barrier layers to minimize electrical leakage through the material from a bonded heating element would not be required. Hence, it was expected that electrical heating elements could be directly bonded to the surface of these glass-ceramics to provide efficient heating units.

However, we have discovered that the modulus of rupture strength of beta quartz-zinc petalite glass ceramics can be substantially reduced when it is attempted to bond electrical heating elements consisting of electrically conductive films directly to the glass-ceramic surface. This problem is particularly severe with cermet films comprising conductive metallic constituents in combination with ceramic binders, but is also observed to some extent with glass-free metallic films.

A related problem which has been encountered pertains to the difficulty of obtaining good bonding between glass-free metallic films and the smooth glass-ceramic surface. Attempts to solve this problem have included the application of ceramic frits to the glass-ceramic surface prior to metal film application, in order to provide a somewhat roughened surface finish. However, these frits also have exhibited a tendency to interact with the glass-ceramic during the application process, and to thereby weaken the plate.

Thus, the major problems of bonding electrically-conductive heating elements to the surfaces of beta quartz-zinc petalite glass-ceramics center around an incompatibility between these glass-ceramics and the metallic, ceramic, and cermet materials which must be bonded thereto in order to provide an integral heating element.

SUMMARY OF THE INVENTION

We have now discovered that certain ceramic compositions may be bonded to beta quartz-zinc petalite glass-ceramics without deteriorating the strength of the substrate material. Moreover, these compositions, when provided as a coatng, protect the glass-ceramic substrate from interaction with ceramic, metallic, or cermet compositions subsequently applied thereto.

Coatings of these compositions are provided from thermally crystallizable glasses which may be applied to a glass-ceramic plate, for example, as powders, to provide a coating of powdered glass thereon. Thereafter the plate and coating are heated to an elevated temperature to sinter the glass, bond the coating to the glass-ceramic plate, and crystallize the glass. The resulting bonded coating, which is characterized as a semicrystalline coating, normally exhibits excellent adherence to the glass-ceramic base plate, yet is fully compatible therewith.

Following the application of this coating, ceramic, metallic and/or cermet films required for the construction of an integral heating element may be fired on to the coated regions of the glass-ceramic plate without weakening or otherwise deteriorating the plate. Thus an electrical heating unit comprising an electrical heating element indirectly bonded to a strong supporting glass-ceramic plate may be provided.

The thermally crystallizable glass which is utilized to provide the protective semicrystalline coating on the glass-ceramic plate is a zinc aluminosilicate glass consisting essentially, in weight percent on the oxide basis, of about 12–25% ZnO, 0–3% MgO, 15–25% total of ZnO + MgO, 15–28% $Al_2O_3$, 50–65% $SiO_2$, 0–1% $K_2O$, 0–5% $Cs_2O$, and 0–4% BaO, including at least 0.5% total of $K_2O + Cs_2O$ + BaO. Glasses within the composition range exhibit the properties of good sinterability, capability of bonding to zinc petalite-beta quartz glass-ceramics, and, in powdered form, fairly rapid crystallization to the semicrystalline state.

Of course, minor amounts of other oxides may be present in these compositions, provided they do not deleteriously affect the sintering, bonding and crystallizing behavior of the glass. However, the use of zirconia and certain of the noble metals, known to nucleate quartz crystals, is preferably avoided, since the extremely rapid crystallization promoted by these additives interferes with the sintering and bonding characteristics required for coating.

These glasses may conveniently be applied to the glass-ceramic plate in powder form, utilizing a suitable binder in combination with the powder if desired. Subsequent heating of the glass powder coating at temperatures above the softening point but below the liquidus temperature of the glass, for a time at least sufficient to obtain the sintering and crystallization thereof, provides the specified semicrystalline coating. The coating consists of a major crystal phase of zinc beta-quartz dispersed in a minor residual glassy matrix. The crystals normally constitute at least about 50% by volume of the material.

The adherence of metallic and cermet films bonded to this semicrystalline coating by firing is excellent. Thus these coatings provide a stable, compatible base for applied electrically-active elements. Neither extensive heating element-coating interactions nor supporting plate deterioration in use have been observed in heating units comprising such coatings.

DESCRIPTION OF DRAWING

The DRAWING consists of an oblique partial schematic view in cross-section of a heating unit provided in accordance with the invention, showing a zinc petalite-beta quartz glass-ceramic burner plate 1 to the lower surface of which is bonded a protective semicrystalline zinc aluminosilicate coating 2. Bonded to the protective coating 2 is an electricaly conductive film 3 which is heatable by the passage of an electric current therethrough. Upon passing an electrical current through film 3, the unit including upper heating surface 4 is heated to provide a source for heating thermal loads in contact with or proximity to surface 4.

DETAILED DESCRIPTION

The glass-ceramic plate comprising the heating and element-supporting surfaces of units provided in accordance with the invention may be composed of any of the known beta quartz-zinc petalite glass ceramics having low thermal expansion and high strength. Examples of suitable compositions are set forth in U.S. Pat. No. 3,681,097 to Beall and Martin, and the disclosure of that patent may be referred to for a full description of the manufacture of beta quartz-zinc petalite glass-ceramic plate. All of these glass-ceramics are of the zinc aluminosilicate type, and any of the disclosed materials having high strength and low expansion may be utilized to provide the glass-ceramic burner plate.

Table I below sets forth some specific examples of compositions of glass-ceramic plates which may be utilized in accordance with the invention. The compositions are set forth in parts by weight on the oxide basis in accordance with conventional practice. Such compositions may of course be modified by the addition of minor quantities of other constituents useful for altering the melting, forming, or other characteristics thereof.

TABLE I

| | Glass-Ceramic Compositions | | | | | |
|---|---|---|---|---|---|---|
| | A | B | C | D | E | F |
| $SiO_2$ | 60.7 | 60.5 | 55.6 | 58.2 | 59 | 59 |
| $Al_2O_3$ | 17.4 | 17.3 | 15.9 | 19.2 | 18.2 | 18.6 |
| ZnO | 15.3 | 15.3 | 22.0 | 13.7 | 14.8 | 14.4 |
| $ZrO_2$ | 5.1 | 5.6 | 4.3 | 5.6 | 5.6 | 5.6 |
| $P_2O_5$ | — | — | — | 1.6 | 1.1 | 1.1 |
| MgO | — | — | — | 1.1 | 0.6 | 0.6 |
| $K_2O$ | — | — | — | — | 0.3 | 0.3 |
| $As_2O_3$ | 0.4 | 0.4 | 0.5 | 0.4 | 0.4 | 0.4 |

All of these glass-ceramics have a crystal content consisting solely of cyrstals selected from the group consisting of beta-quartz solid solution and zinc petalite solid solution.

Strength losses are observed in beta quartz-zinc petalite glass-ceramic plates such as set forth in Table I when any of a number of electrically-conductive metallic compositions, or ceramic compositions applied for protective purposes, are bonded thereto. Table II below sets forth a number of largely metallic compositions which may be bonded to such glass-ceramic plates to provide electrically-conductive films thereon. These compositions consist mainly of mixtures of noble metals, but also include minor amounts, typically 5–10% by weight, of fritted glass to serve as a binder and bonding agent for the metal. The major oxide constituents of the glass bonding agents, and the components of the noble metal mixtures, are set forth.

TABLE II

Conductive Element Compositions

I. 93.7% Pt-Au; 6.3% PbO—$TiO_2$—$SiO_2$ glass
II. 93.7% Pt-Au; 6.3% PbO—$TiO_2$—$SiO_2$ glass + ZnO—$Al_2O_3$—$SiO_2$ glass
III. 93.7% Pt-Au; 6.3% ZnO—$Al_2O_3$—$SiO_2$ glass
IV. 91.5% Pt-Au; 8.5% ZnO—$B_2O_3$—$SiO_2$ glass
V. 92.9% Pt-Au-Rh; 7.1% PbO—$TiO_2$—$SiO_2$ glass
VI. 96% Pt-Au; 4% PbO—$TiO_2$—$SiO_2$ glass Compositions such as set forth in Table II may be directly applied to glass-ceramic plate such as set forth in Table I, for example, by mixing with a suitable oil vehicle, applying by silk screening, and firing at an elevated temperature (e.g., 825°–950°C.) for a time sufficient to sinter and crystallize the glass and bond the glass and metal to the plate. The strength losses typically observed utilizing this procedure are set forth in Table III below, which includes various combinations of glass-ceramic plates and element compositions, as shown in Tables I and II above, the unabraded modulus of rupture strengths of the plate materials without coatings, the unabraded modulus of rupture strengths of the coated plates, and the percent of strength loss observed. Modulus of rupture strengths are determined on glass-ceramic bars of the dimensions 2.75 × 0.50 × 0.150 inches utilizing a double-knife-edge testing apparatus in accordance with conventional practice. The coated bars are tested with the coated surface in tension.

TABLE III

| Strength Losses in Unprotected Plates | | | | |
|---|---|---|---|---|
| Glass-Ceramic Plate Composition (TABLE I) | Conductive Element Composition (TABLE II) | Uncoated Strength (psi) | Coated Strength (psi) | Strength Loss (%) |
| A | I | 16,800 | 15,800 | 6.0 |
| C | II | 28,300 | 13,100 | 45.0 |
| A | I | 16,200 | 11,700 | 27.8 |
| A | II | 16,200 | 12,300 | 24.1 |
| D | III | 24,900 | 20,400 | 18.1 |
| E | IV | 18,500 | 15,800 | 14.6 |
| A | V | 18,200 | 11,800 | 35.2 |

From these and similar data it appears that strength losses incurred upon the application of conductive elements of the kind described to glass-ceramic plates are substantial, being sufficient in most cases to reduce plate strength below values acceptable for range top use.

In addition to conductive elements, a variety of sinterable crystallizable glass frits not containing metals have been applied to glass-ceramic plates for purposes related to the fabrication of heating units. For example, frits have been applied to provide a coating which could protect thin film noble metal elements from mechanical abuse. However, such coatings may themselves harmfully interact with the plate during application to reduce the strength of the plate. Table IV below sets forth examples of sinterable, crystallizable glass frits which may be employed to provide a semicrystalline coating on the plate surface, but which have been found to reduce plate strength. The compositions are reported in parts by weight on the oxide basis in accordance with conventional practice.

TABLE IV

| Interacting Coating Compositions | | | | | |
|---|---|---|---|---|---|
| | M | N | O | P | Q |
| PbO | 66 | 64 | | 58 | 76.6 |
| $TiO_2$ | 14 | 16 | | 14 | |
| $SiO_2$ | 17 | 16 | 12.5 | 24 | 2.2 |
| $Al_2O_3$ | 3 | 2 | | 2 | 0.9 |
| $B_2O_3$ | | 2 | 22.5 | 1 | 9.2 |
| ZnO | | | 65.0 | | 11.0 |
| $Cs_2O$ | | | | 1 | |

Semicrystalline coatings of these glasses may be applied to plate surfaces by mixing powdered glass with a suitable oil vehicle to provide a paste or slury, and then depositing the paste or slurry on the plate by silk screening, doctor blading or other suitable techniques. The powdered glass may be converted to a semicrystalline coating and bonded to the glass-ceramic surface by firing at a suitable elevated temperature, e.g., 825°–950°C., for a time sufficient to sinter and crystallize the glass.

The results of applying semicrystalline coatings such as shown above to glass-ceramic plates are set forth in Table V below. Included in Table V are glass-ceramic plate compositions, as shown in Table I, coating compositions, as shown in Table IV, unabraded modulus of rupture strengths for the uncoated glass-ceramic plate materials, unabraded modulus of rupture strengths for the coated glass-ceramic plates, and the percent of strength loss observed.

TABLE V

| Strength Losses in Unprotected Plates | | | | |
|---|---|---|---|---|
| Glass-Ceramic Plate (TABLE I) | Semicrystalline Coating Compositions (TABLE IV) | Uncoated Strength (psi) | Coated Strength (psi) | Strength Loss (%) |
| A | M | 14,800 | 6,890 | 53.4 |
| A | N | 14,800 | 9,940 | 32.8 |
| B | P | 16,000 | 11,600 | 27.5 |
| B | N | 16,000 | 11,000 | 31.3 |
| E | O | 19,000 | 9,100 | 52.1 |

Thus, we have concluded that semicrystalline coatings such as shown in Table IV may not be directly applied to glass-ceramic plates during the fabrication of heating units, since they act during application to reduce plate strength below acceptable levels.

In contrast to the semicrystalline coating materials described above, the zinc aluminosilicate glasses utilized to provide a protective semicrystalline coating in accordance with the present invention do not appear to cause strength loss in glass ceramic plates to which they are applied. Moreover, these coatings are effective to protect the plate from substantial strength loss during the subsequent application of conductive films, protective layers, terminals, and similar elements thereto.

Examples of glass compositions suitable for providing these protective coatings are set forth in Table VI below. Compositions in Table VI are given in parts by weight on the oxide basis in accordance with conventional practice. Glasses of the recited compositions may be prepared utilizing any of the conventional glass batch constituents by melting in pots, crucibles or other suitable melting units at temperatures in the 1500°–1600°C. range. Powders of these glasses may be prepared by grinding or milling glass frits provided for example, by pouring the molten glass as a thin stream into a quenching medium such as water. Alternatively, glass shapes may be formed by casting, pressing or otherwise forming the glass and these shapes may then be crushed and ground to provide the powder.

TABLE VI

| Glass Compositions for Semicrystalline Coatings | | | | | |
|---|---|---|---|---|---|
| | 1 | 2 | 3 | 4 | 5 |
| ZnO | 19.5 | 19.6 | 19.9 | 19.9 | 15.5 |

TABLE VI-continued

| Glass Compositions for Semicrystalline Coatings | | | | | |
|---|---|---|---|---|---|
| $Al_2O_3$ | 24.4 | 24.5 | 24.9 | 24.85 | 23.4 |
| $SiO_2$ | 53.6 | 53.9 | 54.7 | 54.65 | 56.6 |
| $K_2O$ | — | — | 0.5 | 0.6 | — |
| $Cs_2O$ | 1.95 | 1.93 | — | — | 2.5 |
| MgO | — | — | — | — | 2.0 |
| | 6 | 7 | 8 | 9 | 10 |
| ZnO | 20.0 | 17.8 | 20.0 | 20.0 | 16.4 |
| $Al_2O_3$ | 25.0 | 25.0 | 22.3 | 25.0 | 26.3 |
| $SiO_2$ | 55.0 | 60.0 | 55.0 | 55.0 | 55.0 |
| $K_2O$ | — | — | — | — | — |
| $Cs_2O$ | 3.0 | 3.0 | — | 4.5 | 2.5 |
| BaO | — | — | 3.8 | — | — |
| MgO | — | — | — | — | 2.3 |

In preparing coatings from powdered glasses such as above described, powders having a maximum average particle size of 15 microns, preferably an average particle size in the range of about 8–10 microns, are employed. These powders may be mixed with a suitable binder, such as squeegee oil, to provide a paste or slurry, and then applied to the glass-ceramic plate surface by silk screening, doctor blading, or other techniques suitable for providing a coating. Thereafter the coating may be dried, for example, by heating at 200°C. for one-half hour, to remove the volatile oil vehicle therefrom.

Following the application of the powder coating, the plate and coating are heated to a temperature at least sufficient to sinter the glass of form an integral layer, to bond the glass to the glass-ceramic plate surface, and to crystallize the glass. To obtain good sintering and bonding, it is preferred to first briefly heat the coating and plate to a temperature at which the glass is quite soft, e.g. 900°–950°C., for a time suffient to sinter the glass to form an integral layer, e.g., 5–10 minutes. Thereafter, the plate and coating are further heated to complete the crystallization of the coating to beta quartz and/or zinc petalite. This may be accomplished by a longer exposure to more moderate temperatures, e.g. 800°–900°C. for 1–6 hours. If desired, the powder coating may be applied to an uncrystallized glass plate and the bonding and crystallization of the coating thereafter accomplished in conjunction with the crystallization of the plate.

The semicrystalline coating produced as described not only protects the glass-ceramic plate from strength loss during the subsequent application of conductive elements thereto, but also provides an excellent physical base for the application of such elements, in that improved bonding is obtained therewith. Noble metal-containing elements bonded to these coatings exhibit superior adherence and stability, especially when metallic compositions not containing any glass frit bonding agents are utilized.

The thickness of the fired protective coating should be at least sufficient to protect the plate from interactions with subsequently applied materials. Normally at least about 1 mil is provided, although more may be necessary with some element materials. The coating may be as thick as desired consistent with good bonding and stress considerations, but thicknesses greater than about 5 mils are seldom required.

Table VII below sets forth modulus of rupture data for glass-ceramic plate materials coated with a protective semicrystalline layer in accordance with the invention. Most of the plate comprised a layer of conductive element material bonded to the protective coating. Included in Table VII are the glass-ceramic plate compositions, as specified in Table I, the compositions of the protective coating, as specified in Table VI, the compositions of the conductive elements where applied, as set forth in Table II, the compositions of interacting coating materials where applied, as set forth in Table IV, the modulus of rupture strengths of uncoated control samples for each configuration shown, and the modulus of rupture strengths of the coated plates. The thicknesses of the protective semicrystalline coatings are in the range of about 1–2 mils for all of the configurations shown.

TABLE VII

| Strength Changes in Protected Plates | | | | |
|---|---|---|---|---|
| Glass Ceramic Plate Composition (Table I) | Semicrystalline Layer Composition (TABLE VI) | Conductive Element Composition (TABLE II) | Uncoated Strength (psi) | Coated Strength (psi) |
| A | 1 | V | 17,400 | 18,000 |
| E | 2 | V | 18,600 | 18,900 |
| F | 4 | VI | 14,300 | 15,700 |
| F | 2 | VI | 14,300 | 16,700 |
| INTERACTING COATING COMPOSITION (TABLE IV) | | | | |
| F | 2 | M | 15,600 | 16,600 |
| F | 2 | Q | 15,600 | 17,000 |
| A | 1 | M | 17,400 | 14,700 |

As can be seen from the above data, our protective semicrystalline coatings can effectively prevent the strength losses induced by the bonding of certain conductive materials to zinc petalite-beta quartz glass-ceramics, even enhancing plate strength in some cases.

Electrically conductive films which may be utilized in combination with beta quartz-zinc petalite glass-ceramic plates and protective semicrystalline zinc aluminosilicate coatings to provide heating units in accordance with the present invention comprise noble metals as the conductive ingredients. These noble metals should comprise at least about 90% by weight of the element, and are normally selected from the group consisting of platinum, gold, rhodium and alloys and mixtures thereof.

Where the element comprises less than 100% of these noble metals, the remainder of the element (up to about 10% by weight thereof) may consist of a thermally-crystallizable glass bonding agent. Useful glasses for this purpose include, for example, the thermally crystallizable $ZnO—Al_2O_3—SiO_2$ glasses such as described in U.S. Pat. No. 3,681,097 issued to Beall et al., and the thermally crystallizable $PbO—TiO_2—SiO_2$ glasses such as described in U.S. Pat. No. 3,663,244 to Martin. Thus preferred electrically conductive films for our heating units consist essentially, in weight percent, of about 90–100% total of noble metals selected from the group consisting of platinum, gold, rhodium, and alloys and mixtures thereof, and 0–10% total of a thermally crystallizable glass. If employed, the thermally crystallizable glass is preferably a glass selected from the group of $PbO—TiO_2—SiO_2$ glass compositions crystallizable to lead titanate, and $ZnO—Al_2O_3—SiO_2$ glass compositions crystallizable to beta quartz. However, electrically-conductive films free of crystallizable glass bonding agents and consisting essentially of the above-recited noble metals, or alloys or mixtures thereof, are particularly preferred.

Where compositions for the conductive film comprise a thermally crystallizable glass component, firing treatments comprising exposures to temperatures sufficient to sinter and crystallize the glass, typically temperatures in the range of 825°–950°C., are used to bond the film to the protective semicrystalline coating. Otherwise conventional procedures for the application of noble metal films are employed.

The invention will be further understood by reference to the following detailed example illustrating procedures for the construction of an electrical heating unit in accordance therewith.

EXAMPLE

A glass plate about 21⅝ × 12⅜ × 20 inches in size is selected for coating. The plate is composed of a glass which is crystallizable to a beta quartz-zinc petalite glass-ceramic, having an approximate composition, in weight percent on the oxide basis of about 14.4% ZnO, 18.6% $Al_2O_3$, 59.0% $SiO_2$, 5.6% $ZrO_2$, 1.1% $P_2O_5$, 0.6% MgO, 0.3% $K_2O$, and 0.4% $As_2O_3$.

A quantity of glass having an oxide composition of about 19.6% ZnO, 24.5% $Al_2O_3$, 53.9% $SiO_2$, and 1.93% $Cs_2O$ is melted at 1650°C., cast into small slabs, crushed and ground, and finally milled to provide a glass powder having an average particle size of about 10 microns.

The glass powder prepared as described is blended with a quantity of a volatile oil medium in the ratio of about 100 grams of glass to about 40 grams of oil, in order to provide a mixture of a consistency suitable for silk screening. The oil utilized is No. 324 medium, available from Drakenfeld Colors, Hercules Inc., Washington, Pennsylvania. The resulting mixture is applied to the bottom surface of the glass plate through a 196 mesh NITEX screen, utilizing conventional screening techniques, to provide a continuous coating on the bottom surface of the plate. This coating is then dried at 200°C. for one-half hour to remove the oil.

The coating and plate are then preheated at 750°C. for 10 minutes and placed for 10 minutes in an electric furnace maintained at 950°C. to sinter the glass powder to an integral coating. The plate and coating are then transferred hot to another furance operating at 840°C. and maintained at that temperature for 2 hours to develop a zinc petalite-beta quartz crystal phase in the glass plate, and to crystallize the sintered glass coating to provide the protective semicrystalline coating. The plate and coating are then removed from the furnace and cooled to room temperature.

A conductive composition for an electrical heating element consisting of about 35.3% Pt, 17.7% Au, 45.0% of a medium viscosity squeegee oil, and 2% of a powdered $PbO—TiO_2—SiO_2$ glass is selected for application to the coated surface portion of the plate. The powder glass component of this composition consists of a glass containing 66% PbO, 14% $TiO_2$, 17% $SiO_2$, and 3% $Al_2O_3$ by weight, having an average particle size of about 10 microns.

The conductive composition is applied to the coated surface portion of the plate in a configuration such as described in U.S. Pat. No. 3,813,520 to Brouneous, utilizing a 306 mesh silk screen and conventional silk screening techniques. The protective plate with element coating is then heated at 200°C. for one-half hour to dry the coating and thereafter heated in an electric furnance operating at 840°C. for one-half hour to bond the conductive coating to the protective coating.

The process of applying the conductive composition by silk screening is repeated to double the thickness of the coating which composes the electrical heating element configuration. However, after the second application, the coated plate is heated at 840°C. for 1½ hours to complete the bonding of the element configuration to the coated plate. This heat treatment also completes the crystallization of the glass-ceramic plate. The bonded film making up the element has an electrical resistance of 0.35 ohms per square.

Following the application of the electrical heating element to the plate as described, silver terminals are applied to the element in the conventional manner to provide a completed heating unit. When an electrical voltage is thereafter applied to the terminals, efficient heating of the top surface of the plate, and thermal loads applied thereto, are accomplished.

Service testing of electrical heating units provided in accordance with the foregoing example indicates that substantial improvements in efficiency over the efficiency of discrete element units are realized. No impact breakage of the heating units is encountered.

We claim:

1. An electrical heating unit comprising:

a. a glass-ceramic plate composed of a zinc petalite-beta quartz glass-ceramic material;

b. a protective semicrystalline coating bonded to at least a portion of a surface of the glass-ceramic plate, said coating consisting essentially of a sintered, crystallized zinc aluminosilicate glass, said glass having a composition consisting essentially, in weight percent on the oxide basis, of about 12–25% ZnO, 0–3% MgO, 15–25% total of ZnO + MgO, 15–28% $Al_2O_3$, 50–65% $SiO_2$, 0–1% $K_2O$, 0–5% $Cs_2O$, 0–4% BaO, and at least about 0.5% total of $K_2O + Cs_2O$ + BaO; and c. an electrical heating element consisting of an electrically conductive film bonded to said protective semicrystalline coating, said film consisting essentially in weight percent, of about 90–100% total of noble metals selected from the group consisting of gold, platinum, rhodium and alloys and mixtures thereof, and 0–10% total of thermally crystallizable glass.

2. An electrical heating unit in accordance with claim 1 wherein the thermally crystallizable glass is selected from the group consisting of:

a. $PbO—TiO_2—SiO_2$ glass compositions crystallizable to lead titanate, and b. $ZnO—Al_2O_3—SiO_2$ glass compositions crystallizable to beta quartz.

3. An electrical heating unit in accordance with claim 1 wherein the electrically-conductive film consists essentially of noble metals selected from the group consisting of gold, platinum, rhodium and alloys and mixtures thereof.

* * * * *